United States Patent [19]

Pikul

[11] 4,120,621

[45] Oct. 17, 1978

[54] OIL SEALED SINGLE STAGE VACUUM PUMP

[75] Inventor: Richard E. Pikul, DeSoto, Mo.

[73] Assignee: Puritan Bennett Corporation, Kansas City, Mo.

[21] Appl. No.: 706,937

[22] Filed: Jul. 19, 1976

[51] Int. Cl.[2] ..... F04C 27/02

[52] U.S. Cl. ..... 418/99

[58] Field of Search ..... 418/76, 96, 97, 98, 418/99

[56] References Cited

U.S. PATENT DOCUMENTS

| | | | |
|---|---|---|---|
| 2,077,394 | 4/1937 | Buenger | 418/98 |
| 2,816,702 | 12/1957 | Woodcock | 418/99 |
| 3,525,578 | 8/1970 | Le Blanc, Jr. | 418/96 X |
| 3,838,950 | 10/1974 | Andriulis | 418/76 |

*Primary Examiner*—Carlton R. Croyle
*Assistant Examiner*—Leonard E. Smith
*Attorney, Agent, or Firm*—Paul M. Denk

[57] ABSTRACT

In a vacuum pump, of the type being a single stage operative pump, a stator housing is provided and having rotatively mounted therein an eccentrically disposed rotor, which rotor is revolved by means of a motor, with the eccentric mounting of the rotor providing a point of contiguity between the rotor and the stator housing; a slot is provided approximate the location of the point of contiguity between the rotor and stator, and an oil reservoir supplies a quantity of oil to and through the slot to form a seal at this point of contiguity between the pump rotor and stator housing.

2 Claims, 5 Drawing Figures

OIL SEALED SINGLE STAGE VACUUM PUMP

BACKGROUND OF THE INVENTION

This invention relates generally to a vacuuming device, but more particularly pertains to an improved single staged oil sealed vacuum pump.

There are a variety of vacuum pumps that are readily available upon the market and most of these pumps are of the type whose efficiency of operation, viz., to evacuate an area down to an approximate absolute vacuum, depends upon the complexity of their make up. For example, most single stage vacuum pumps generally exhibit evacuation levels that cannot approach an absolute vacuum by an amount any less than 0.05 to 0.005 mm of mercury. To achieve any closer degree of evacuation, i.e., closer to an absolute vacuum, generally requires the use of a dual or multi-stage vacuum pump which may then approach an absolute vacuum by an amount generally not in excess of 0.0005 mm of mercury.

Examples of the latter type of pumps, that is a two-stage of multi-stage pump is shown in the U.S. Pat. to Dubrovin, No. 2,337,849, which may approach the latter mentioned proximity to an absolute vacuum through its operation. But, such a pump, as shown, is a multi-stage type of pump, and thereby requires the overlapping action of multi-cylindered evacuation in order to attain a closer proximity to an absolute vacuum, and by necessity, constitutes a pump of much greater structural components than is required in the designed pump in this application.

Other examples of vacuuming pumps that can attain a low degree of vacuuming is shown in the U.S. Pat. to Le Blanc, No. 3,326,456, another patent to Le Blanc, U.S. Pat. No. 3,371,857, and finally, the vacuum pump shown in the patent to Wessling, U.S. Pat. No. 3,040,973. But, as previously analyzed, most of these pumps are of the multi-stage operative type, and are much more complex in structure, and therefore, by necessity, more expensive in their make up to attain the same degree of vacuuming precision as can be attained by the single stage pump of this invention.

It is, therefore, the principle object of this invention to provide a single stage oil sealed vacuum pump that can attain levels of evacuation approaching an absolute vacuum that are comparable to the degree of vacuuming as currently attained from multi-staged vacuum pumps.

A further object of this invention is to provide a single stage vacuuming pump that is of approximately one-third the volume of vacuum pumps of comparable design.

It is another object of this invention to provide a single stage oil sealed vacuum pump that is of a much lesser weight than comparable vacuum pumps currently available.

Another object of this invention is to provide a single stage vacuuming pump that is totally self-contained, requiring the use of no extraneous pulleys or vee-belts, or even guards for the same, but rather, attains its drive directly from an integrally connected motor.

Another object of this invention is the provision of a vacuuming unit that contains an integral vapor filter associated with its exhaust port thereby eliminating the need for any accessory filter as normally required in contemporary high vacuuming pumps.

An additional object of this invention is to provide a vacuuming pump that is attractively styled and equipped with integral components that readily allow for its support upon a surface, while at the same time providing gripping means that facilitates its ease of conveyance, thereby making it more portable.

Another object of this invention is to provide a vacumming pump wherein its transfer gearing from the motor to the rotor of the pump is bathed in a quantity of lubricant thereby facilitating the mechanical operations of the device, while at the same time substantially reducing the noise level of its operations.

Another object of this invention is to provide a vacuuming pump that is easy of assembly, having relatively few operative components, and therefor lends itself well to mass production assembly.

These and other objects will become more apparent to those skilled in the art upon reviewing the summary of this invention, and upon studying the description of its preferred embodiment in view of its drawings.

SUMMARY OF THE INVENTION

The vacuum pump of this invention includes a housing that generally provides support for the various operative components of the pump, such as its stator, and which includes means for supporting in bearing mounted fashion the rotor that is eccentrically arranged within the said stator. The housing is designed to provide space for holding a quantity of oil or other lubricant within close proximity to the various operative components of the pump, and has designed conduits that allow for conveyance of oil at all times to, for example, the shaft of the rotor, the transfer gearing that transmits power from the motor to the rotor shaft, and in addition, and more importantly, provides a quantity of oil to a slot that is arranged in close proximity to that location of contiguity between the rotor and the interior wall of the stator so as to provide a seal of oil thereat to thereby enhance the efficiency of operation and evacuation through the use of this pump. As previously commented, the pump further includes designed structure that functions as a base for support of the pump during usage, and also includes a formed handle that can assist in its portability when transferred from one location to another.

The main use of this particular pump, at this time, is in the rather detailed diagnostic work that is performed in analyzing various operations of the body, and particularly, its pulmonary system. Hence, the higher degree of vacuuming that can be provided for the medical instrumentation utilized in analyzing body functioning, and particularly pulmonary operations, the greater the degree of precision in the analysis that can be made by the medical examiner during his testing. As previously commented, there are a number of scientific vacuum pumps that are currently available, and even for use in the biomedical instrumentation field. Such pumps, however, are generally of a larger capacity than is required for this type of usage, and consequently, the existing units are both large in a physical size and weight, and in many cases exhibit a noise level that is just too high for use in clinical laboratories, generally exhibiting a high degree of annoyance to the surrounding personnel. Therefore, recently much interest has been expressed in the design and availablility of a compact vacuum source which would lend itself to more portable applications, and generally fit better into the environment of medical diagnostic work. The highly efficient minature vacuum pump of this invention is designed to circumvent these foregoing disadvantages, and to present a unit that can satisfy the current needs of the medical profession.

The vacuum pump of this invention is a self contained unit, utilizing, as commented, a basic eccentric rotary vaned pump configuration, which is designed to required minimum mechanical power to achieve the required pumping capacity to attain very lower levels of evacuation, very much approaching an absolute vacuum. The application of a vacuum pump of this type in medical operations requires a very high degree of reliability under a minimum of maintenance conditions, and therefore, in the preferred embodiment, the motor providing rotation to the rotor of this pump is preferably of a compact brushless induction motor type as the source of main power. Unfortunately, compact brushless induction motors of a reasonable horsepower rating are not readily commercially available, and to the size requirements for this invention, so that this invention, therefore, can utilize an induction motor having a horsepower rating approximately equal to one-third of that of the smallest motor currently used on available vacuum pumps functioning in the medical diagnostic field. Due to the general unavailability of the type of motor desired, particular attention had to be given to the design of the pump itself, so that it could utilize all available mechanical power to its best advantage. A single pass helical gear transmission providing the drive connection between the motor and the rotor of the pump is provided for running in an oil bath, and has exhibited the most efficient means for coupling of the induction motor to the pump proper. This method exhibits good durability and eliminates, entirely, all sources of noise stemming from the type of vibration that are normally encountered through equivalent type pumps that incorporate pulleys and the vee-belt type drive configuration.

The vacuum pump of this invention, as previously commented, is basically an eccentric rotary vane pump with rather unique innovations designed to circumvent the restraints normally imposed by only a tangential point of contact between the pump rotor and the inside diameter of the stator interior wall housing. In this manner, a definite decrease in the drag and mechanical power needed to rotate the pump is attained. And, in order to maintain the pump efficiency under conditions of minimum mechanical power through the use of a rotary vane configuration, the pump incorporates particularly designed oil seals, as previously briefly analyzed. In the preferred embodiment, this feature consists of a thin rectangular slot of approximately 0.010 inches wide that traverses approximately eighty percent of the width of the rotor housing at the tangential point of contact between the rotor and the stator housing. Also in the preferred embodiment, and to enhance the efficiency of operation of the pump, the slot is displaced approximately one degree towards the inlet or intake side of the pump so as to provide an oil seal at this location between the rotor and the stator at just slightly past their tangential point of contact. Actually, this offset could be disposed as much as five degrees from the point of contact, but it has been found that a one degree offset operates most effectively, with the offset being in the direction of the intake side of the pump. The oil flow through this rectangular slot is approximately proportional to the differential pressure existing between the outside and the inside of the pump housing. Consequently, as the pump reaches a lower internal pressure, greater oil flow occurs through the flow seal slot and provides a better seal at this tangential point of contact. This action reduces the blow-by between the exhaust cycle and the inlet cycle of the pump, and thereby, maintains an overall pumping efficiency, even at a very high level within a single stage operative pump.

Other lubricating features are provided within the pump of this invention, wherein there are provided symmetrical oil feed for both of the front and rear bearing bosses, as obtained through oil passages located in the rotor shaft. Also connected to the front and rear bearing bosses is a curvilinear passage that is cast directly into the main frame of the housing coverplate, and which is designed to distribute excess oil from these bearing mounts and to the sides thus effecting an oil seal at both sides of the rotor. Additional oil passages are provided in the rotor, located just beyond each vane, and thereby directs oil from the rotor shaft to behind the vanes and thus effects oil sealing at each of the vanes within the rotor to thereby enhance the efficiency of evacuation and operation of this pump. Thus, the highly lubricated single stage pump of this invention not only reduces the mechanical drag that is normally exhibited in the multi-stage pumps, but at the same time, the lubricating oil provides proper seals at those locations where they enhance the degree of the evacuation to be attained from the operations of this invention.

DESCRIPTION OF THE PREFERRED EMBODIMENT

Figure 1:
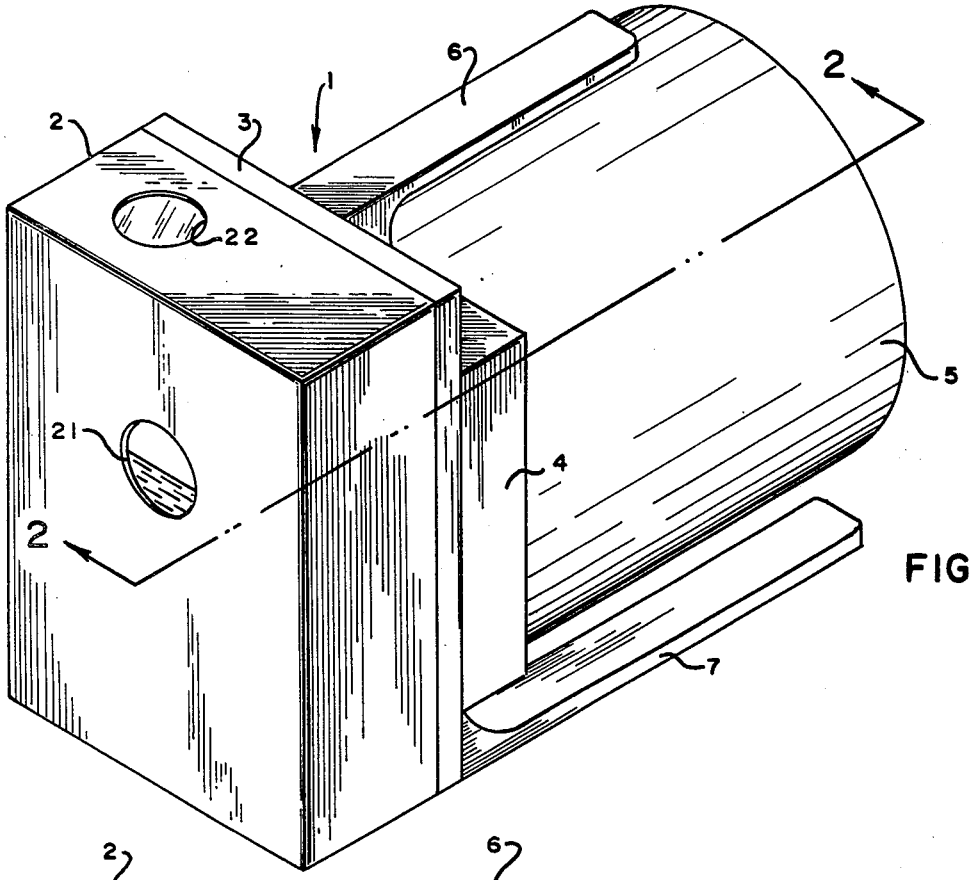
FIG. 1 provides a perspective view of the entire vacuuming pump and its associated motor of this invention.

In referring to FIG. 1 of the drawings, there is shown the vacuum pump 1 of this invention which includes a housing 2 having a closure member 3 securing its backside, and a gear box 4 that holds the various gearing that provide for the transmission of rotating power from the motor 5. As can also be seen in FIG. 2, the closure member 3 has additionally secured to it, and extending rearwardly therefrom, a length of handle 6 that facilitates the carriage of the pump, while extending from the bottom portion of said closure member 3 are a pair of base members, such as one shown at 7, with one provided to either side of the bottom of the closure member, so as to stabilize the positioning of the vacuum pump upon a surface when at rest.

The motor means 5 of this invention, as previously briefly analyzed, may be any form of fractional horsepower motor that can provide for the rapid revolution of the operative components of the pump per se, but preferably, the pump will be of an induction motor type, and further, if available, be of the compact brushless type. Although, other motors may be employed to provide operational power to this pump.

Figure 2:
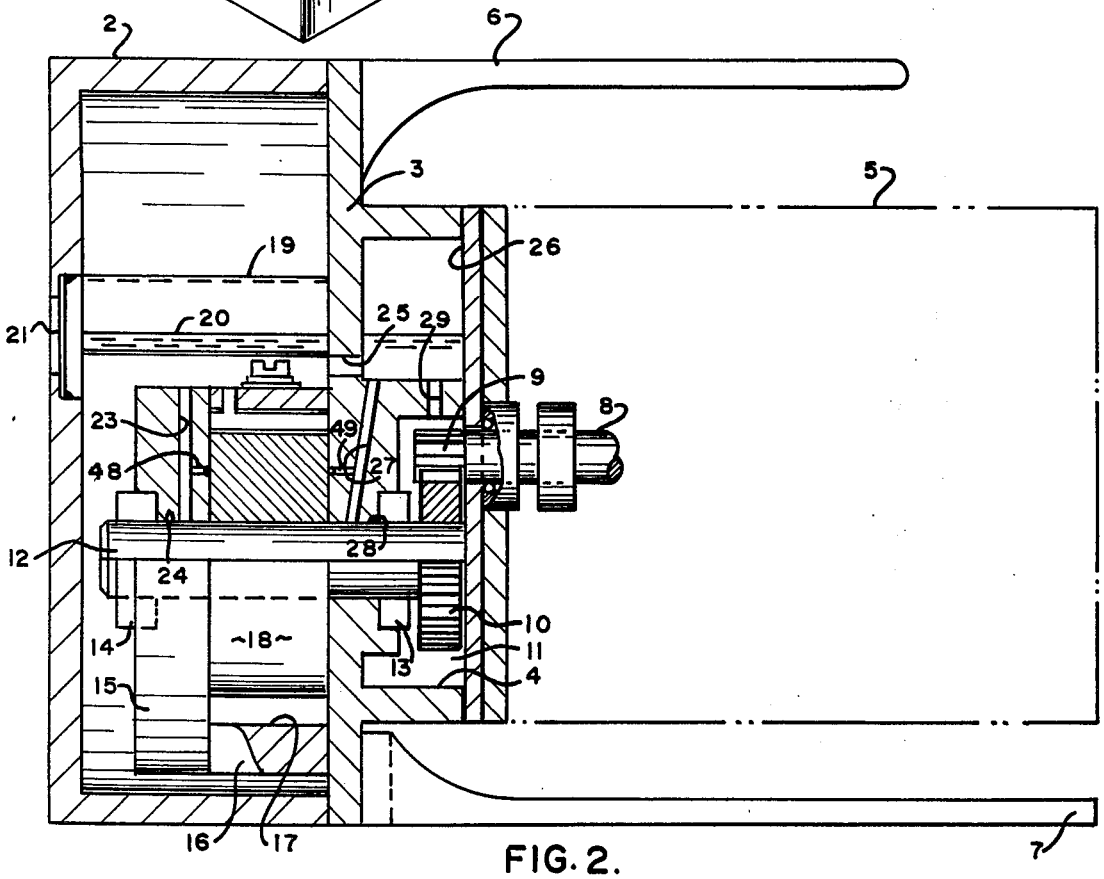
FIG. 2 provides a sectional view along the length of the vacuum pump of this invention taken along the line 2—2 of FIG. 1.

As can also be seen in FIG. 2, the rotating shaft 8 of the motor incorporates a spur gear 9 at its one end, and which gear intermeshes with a reduction gear 10 that is provided mounted upon the end of the pump shaft 11. These gearings 9 and 10 are contained within the gear box or housing 4, and also contained therein during the operation of the pump is a supply of oil, as contained at 11, so as to both lubricate these operative components of the pump, but also, to provide for significant noise reduction in the operations of such a device. Seated within a counterbored section of the closure member 3 is an oil seal 13, while at the opposite end of the shaft 12 is another oil seal 14. This end of the shaft 12 is mounted for revolving movement within the cover 15 of the pump housing, and this cover secures around the periphery of the side of the pump stator 16, which stator includes an interior cylindrical surface 17 that cooperates with the rotor 18 that is mounted to and rotates with the shaft 12 of the said pump.

The housing 2 for the pump proper disposes the various pumping components therein, as just previously described, and this housing, in conjunction with the closure member 3, cooperate to provide a reservoir for maintaining a supply of oil therein. In the upward part of the housing 2 is provided a baffle 19 that is designed to prohibit the upward splashing of the oil within the pump, with the oil level normally being maintained within the housing to an approximate height as shown at 20. A transparent viewer 21 is provided proximate the maintained oil level within the housing so that one can readily see that an adequate quantity of oil is provided within the pump to provide for its proper maintenance and operation. Provided through the top of the housing 2 is an exhaust port 22 through which the gaseous material being evacuated by the pump is allowed to attain release to the atmosphere. Furthermore, by maintaining the level of oil within the pump as shown, it can be seen that the passage 23 provided through the cover 15 allows for the transmittal of oil for lubricating purposes to the location of the bearing surface between the cover and the shaft 12 rotating therein, such as at the position 24. In addition, a passage 25 is provided through the closure member 3, and allows for oil to flow to a supplemental reservoir, as at 26, and then through the passage 27 and to the bearing surface 28 intermediate the closure member 3 and where the shaft 12 rotates therein. Although not shown, any form of standard bearings may be provided around the shaft 12 to facilitate its turning within the cover 15 and the member 3. Furthermore, another passage 29 is provided through the upper wall of the formed gear box 4 so as to allow a quantity of oil to be maintained within the reservoir 11, for the purposes as previously described. Hence, significant lubrication is provided throughout all operative segments of the pump, and its gearing, so as to provide as near frictionless operation of the pump as possible, in addition to enhancing its quiet performance.

Figure 3:
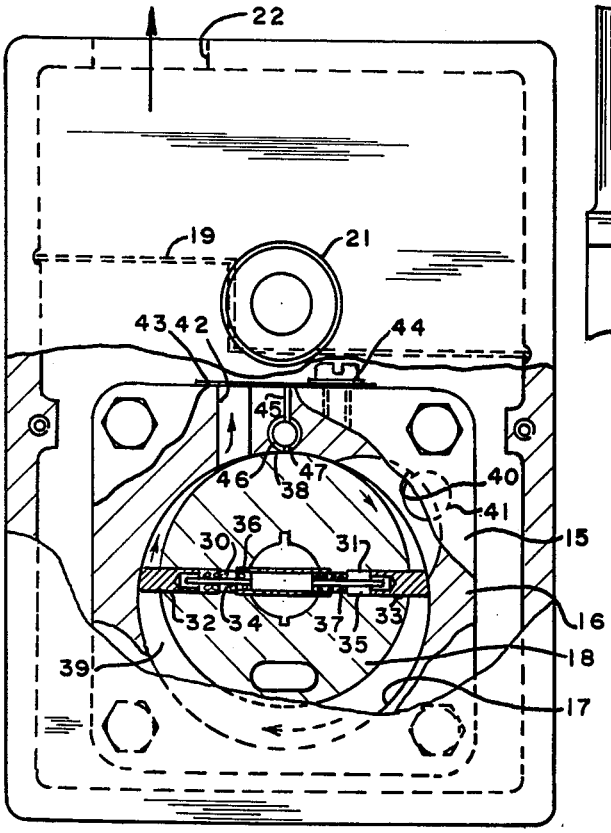
FIG. 3 provides a front view, with part of the cover plate removed, so as to disclose the internal operations of the pump portion of the invention.

In referring to FIG. 3, it can be seen that the rotor 18 is eccentrically mounted within the stator 16, with the rotor having a series of slots 30 and 31 arranged therein and designed for accommodating the vanes 32 and 33 for radially slidable disposition therein. The vanes incorporate pins 34 and 35 extending from their inward ends, and springs 36 and 37 are provided for constantly biasing the vanes outwardly of the rotor, and against the interior surface of the cylindrical wall 17 of the stator.

Since the rotor 18 is eccentrically mounted, as previously explained, within the stator 16, the rotor sustains a point of contiguity, as at 38, with the inner surface 17 of the stator 16. Thus, a crescent pumping chamber, as at 39, is provided intermediate the rotor and stator. Since the rotor of the shown pump was designed for rotating in a clockwise direction, at its intake segment there is formed a cavity, as at 40, which communicates with both the passage 39, and also to an intake line 41, which line communicates with the space to be vacuumed. Thus, as the rotor rotates and its vanes simultaneously move along the inner surface 17 of the stator, the pump will draw in the gas or other air to be evacuated. Likewise, as the vanes reach the halfway point in the rotation of the rotor, any further rotation within the passage 39 begins to decrease in volume and thereby causes a pressure forcing of the evacuated gases to be moved through the outlet port 42, past the reed valve 43, through the oil reservoir and past the baffle 19, to be exhausted out of the port 22. The reed valve 43 is held in place by means of the screw 44.

Figure 4:
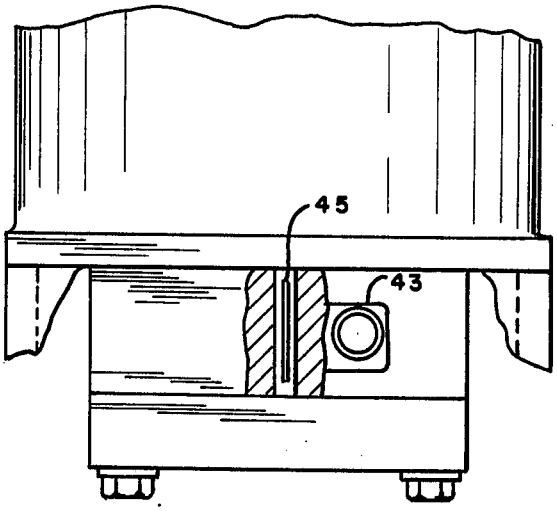
FIG. 4 provides a partial plan view of the pump of this invention, with a segment of the pump housing being removed so as to disclose the location of the oil seal slot.
Figure 5:
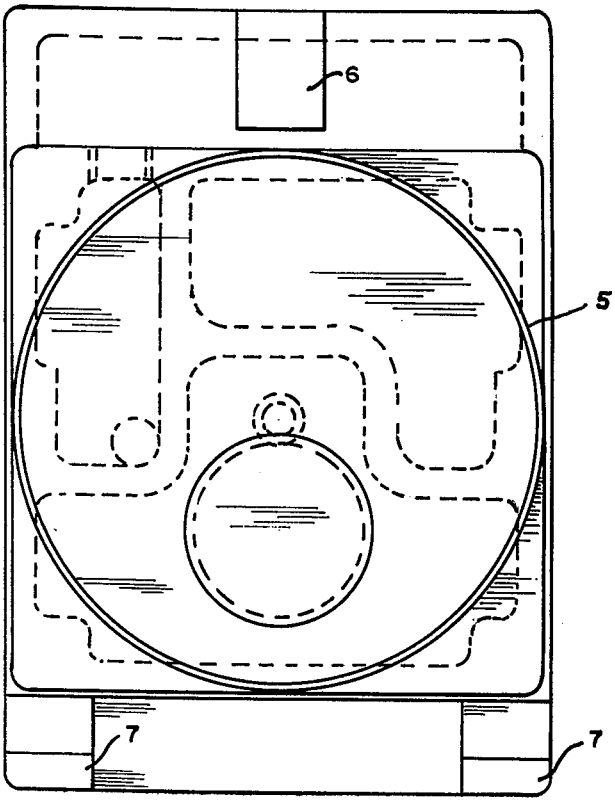
FIG. 5 provides a back side view of the pump and motor of this invention.

One of the problems heretofore that has plagued prior single stage vacuum pumps has been maintaining the efficiency of operation of the pump and avoiding or reducing the escape of gases between the intake and exhaust segments of the operating pump. Usually, slippage occurs at the point where the rotor meaintains contiguity, as at point 38, with the stator, and in this particular invention, this problem has been remedied, or at least rectified, to the extent that this invention has significantly enhanced the efficiency of operation of a pump and allows it to evacuate gases down to 0.0001 mm of mercury, far below what has been attained from prior single stage vacuum pumps. As can be seen in FIGS. 3 and 4, the stator in its upward segment has provided through it a slot 45 that communicates with a minor reservoir 46 that is designed to supply oil through the secondary slot 47 to maintain a constant seal between the rotor and stator at this location, and thereby prevent the passage of any gas therepast. As can also be seen in FIG. 4, the slot 45 is wider than the reed valve 43, and therefore oil can be supplied at all times to the supplemental reservoir 46, for maintaining a constant fill of oil and to allow its flow for sealing purposes at this location between the rotor and stator. Furthermore, and as also can be seen from FIG. 4, the slot 47 is slightly offset, approximately one degree to five degrees, preferably towards the pump intake side, so that the oil passing through the slot 47 will be constantly pulled by means of the rotating rotor towards this intake side of the pump. Hence, and in practice, this particular feature in this pump has provided a very adequate seal between the intake and outlet sides of the pump, and has worked effectively to enhance the efficiency and degree of evacuation attained from this single stage pump.

To also enhance the seal of the rotor with respect to the stator, and thereby increase the efficiency of operation of the pump, there may also be provided a channel, as at 48, and this channel is provided for conveying lubricant, as passing through the passage 23, to the sides of the rotor 18 so as to provide an oil seal at this location. Furthermore, a similar type of channel 49 may convey lubricant from the passage 27 and to the opposite side of the rotor 18, thereby forming an oil seal at this location. Both of these channels 48 and 49 may be curvilinear in their extent, providing further grooves that are formed into the inner walls of the cover 15 and the closure member 3, respectively, so as to supply oil to the location intermediate the rotor 18 and the said cover and closure member. In this manner gases being acted upon by the vanes of the rotor will be confined within the passage 39, and not be allowed to leak or escape around the rotor during functioning of this pump.

Many variations to this invention may occur to those skilled in the art upon reviewing the subject matter of this invention. Any such variations, if within the spirit and scope of this invention, are intended to be protected by any claims attained in a United States patent upon this invention. The description of the preferred embodiment, in view of the drawings, is set forth for illustrative purposes only.

Having thus described the invention, what is claimed and desired to be secured by Letters Patent is:

1. A rotary oil sealed single stage vacuum pump for producing an approximate absolute vacuum, comprising a cylindrical stator, a rotor eccentrically positioned for rotation within said stator, said stator having an interior wall, at least a pair of vanes radially disposed within and biased outwardly of said rotor, the outer ends of said vanes being in sliding contact with the inner cylindrical wall of the said stator, said rotor at one location being in contiguity with a segment of the interior wall of said stator, a crescent shaped pumping chamber being provided between the remaining portions intermediate the said rotor and the stator wall, there being a pump intake and an outlet port provided respectively to either side of the said rotor and stator location of contiguity, a valve means normally closing said outlet port, an oil slot formed through the said stator wall, proximate the location of its contiguity with the rotor and disposed for furnishing a quantity of oil to the said location for forming an oil seal thereat, said oil slot being offset between about 1° to 5° from the precise point of contiguity between the said rotor and stator, and being located closer to the pump intake, said oil slot being continuous along its length and being wider than the said valve means to provide for a constant flow of oil to said oil port and for formation of the oil seal at this location of rotor and stator contiguity, the length of said oil slot being less than the width of the pump rotor, said pump having a reservoir, said reservoir communicating with the outlet port and the oil slot and designed for supplying a quantity of oil to the location of the valve means and the location of contiguity between the said rotor and stator for forming the said seal thereat.

2. The invention of claim 1 and including channels being provided communicating between the said oil reservoir and the sides of the stator housing to provide for the conveyance of lubricant to the sides of the said rotor so as to provide for the creation of an oil seal at this location.

* * * * *